US011136805B2

(12) United States Patent
Schmid

(10) Patent No.: US 11,136,805 B2
(45) Date of Patent: Oct. 5, 2021

(54) FURNITURE DRIVE FOR MOVING A MOVABLY MOUNTED FURNITURE PART

(71) Applicant: Julius Blum GmbH, Hoechst (AT)

(72) Inventor: Malte Schmid, Bodolz (DE)

(73) Assignee: Julius Blum GmbH, Hoechst (AT)

( * ) Notice: Subject to any disclaimer, the term of this patent is extended or adjusted under 35 U.S.C. 154(b) by 85 days.

(21) Appl. No.: 16/526,282

(22) Filed: Jul. 30, 2019

(65) Prior Publication Data

US 2019/0352952 A1 Nov. 21, 2019

Related U.S. Application Data

(63) Continuation of application No. PCT/AT2018/060015, filed on Jan. 18, 2018.

(30) Foreign Application Priority Data

Jan. 31, 2017 (AT) ..... A 50068/2017

(51) Int. Cl.
*E05F 3/20* (2006.01)
*E05F 1/08* (2006.01)
(Continued)

(52) U.S. Cl.
CPC ..... *E05F 1/1041* (2013.01); *E05D 15/46* (2013.01); *E05Y 2600/626* (2013.01); *E05Y 2900/20* (2013.01)

(58) Field of Classification Search
CPC ..... E05F 3/20; E05F 1/1276; E05F 1/1246; E05F 1/1041; E05F 1/1253; E05F 1/1261; E05F 1/1058; E05F 1/1075; E05F 1/14; E05D 3/06; E05D 3/12; E05D 3/16; E05D 3/18; E05D 5/0276; E05D 11/00; E05D 11/11; E05D 15/46; E05Y 2201/21; E05Y 2201/264; E05Y 2201/47; E05Y 2201/492;
(Continued)

(56) References Cited

U.S. PATENT DOCUMENTS 4,361,931 A * 12/1982 Schnelle ..... E05D 5/08 16/252
5,056,189 A * 10/1991 Brustle ..... E05D 7/125 16/235
(Continued)

FOREIGN PATENT DOCUMENTS

CN 102066682 5/2011
CN 102900295 1/2013
(Continued)

OTHER PUBLICATIONS

International Search Report dated Mar. 28, 2018 in International (PCT) Application No. PCT/AT2018/060015.
(Continued)

*Primary Examiner* — Chuck Y Mah
(74) *Attorney, Agent, or Firm* — Wenderoth, Lind & Ponack, L.L.P.

(57) ABSTRACT

A furniture drive for moving a movably mounted furniture part relative to a furniture body includes a drive unit to be mounted on or in the furniture body, and at least one movably mounted actuating part for moving the movable furniture part. A mounting stop that can be applied to the furniture body is provided on the drive unit.

14 Claims, 6 Drawing Sheets

(51) Int. Cl.
*E05F 1/10* (2006.01)
*E05D 15/46* (2006.01)

(58) Field of Classification Search
CPC ..... E05Y 2201/618; E05Y 2600/626; E05Y 2900/20; E05Y 2900/202; A47B 2220/0072; Y10T 16/5383; Y10T 16/547; Y10T 16/5476; Y10T 16/5357; Y10T 16/5358; Y10T 16/5363; Y10T 16/5367
See application file for complete search history.

(56) References Cited

U.S. PATENT DOCUMENTS

| | | | | |
|---|---|---|---|---|
| 5,611,112 | A * | 3/1997 | Rock | E05D 7/04 16/237 |
| 5,671,538 | A | 9/1997 | Lautenschlager | |
| 7,500,287 | B2 * | 3/2009 | Brustle | E05F 1/1075 16/286 |
| 7,810,213 | B2 * | 10/2010 | Brustle | E05F 5/02 16/286 |
| 8,056,991 | B2 * | 11/2011 | Hollenstein | E05F 1/1058 312/312 |
| 9,181,743 | B2 | 11/2015 | Kashiwaguma | |
| 9,664,215 | B2 * | 5/2017 | Laird | E05D 7/0415 |
| 9,791,016 | B2 * | 10/2017 | Kuzukawa | F16F 13/20 |
| 2007/0257538 | A1 * | 11/2007 | Brunnmayr | E05D 15/262 297/423.12 |
| 2009/0307869 | A1 | 12/2009 | Salice | |
| 2013/0026114 | A1 | 1/2013 | Kashiwaguma | |
| 2013/0026318 | A1 | 1/2013 | Kashiwaguma | |
| 2017/0044812 | A1 * | 2/2017 | Schluge | F16H 21/44 |
| 2017/0260784 | A1 * | 9/2017 | Laird | E05D 5/065 |
| 2018/0298661 | A1 | 10/2018 | Salice | |

FOREIGN PATENT DOCUMENTS

| | | |
|---|---|---|
| DE | 20 2013 007 519 | 11/2013 |
| EP | 0 851 084 | 7/1998 |
| EP | 2 078 811 | 7/2009 |
| EP | 2 551 432 | 1/2013 |
| JP | 2011-524479 | 9/2011 |
| JP | 2013-28976 | 2/2013 |
| JP | 2013-87602 | 5/2013 |
| TW | 1476318 | 3/2015 |
| WO | 2008/031814 | 3/2008 |
| WO | 2009/152537 | 12/2009 |
| WO | 2016/174076 | 11/2016 |

OTHER PUBLICATIONS

Search Report dated Nov. 13, 2017 in Austrian Application No. A 50068/2017, with English translation.

* cited by examiner

FURNITURE DRIVE FOR MOVING A MOVABLY MOUNTED FURNITURE PART

BACKGROUND OF THE INVENTION

The present invention concerns a furniture drive for moving a movably mounted furniture part relative to a furniture body. The furniture drive comprises a drive unit for mounting to or in the furniture body, and at least one movably mounted actuating portion for moving the movable furniture part.

The invention further concerns an article of furniture comprising at least one such furniture drive. Finally, the invention concerns a method for mounting a furniture drive to or in a furniture body.

Furniture drives are already known, which are positioned by means of "ruler and pencil" at or in a furniture body. However, a disadvantage with the known positioning procedure is the fact that that such positioning is only highly inaccurate and is only possible with a high level of complication and effort. A correct mounting position more specifically is a necessary prerequisite so that the furniture part can be moved properly in the mounted state.

DE 20 2013 007 519 U1 discloses, for example, a mounting plate which is adapted for fixing two or more actuating drives with housings of differing designs.

SUMMARY OF THE INVENTION

It is an object of the invention to eliminate at least one of the above-described disadvantages and to provide a furniture drive which is improved over the state of the art, and an improved article of furniture having at least one furniture drive so as to permit simplified mounting of the furniture drive to or in a furniture body.

A further object of the invention is to provide an improved method for mounting a furniture drive to or in a furniture body in order once again to ensure simplified and in particular standardized mounting.

An essential idea in regard to the furniture drive according to the invention is that at least one mounting abutment configured to bear against the furniture body is provided on the drive unit. By virtue of that measure, the furniture drive can be positioned at a predetermined mounting position on or in a furniture body.

In other words, the furniture drive can have at least one mounting abutment configured to bear against a front face of the furniture body, and the drive unit, by virtue of the mounting abutment bearing against the front face of the furniture body, can be positioned at a predetermined mounting position on or in the furniture body. In that respect, the furniture body can have at least one vertically extending side wall. Preferably, the front face of the furniture body is formed by a vertically extending narrow side of that side wall. As an alternative thereto, the end is formed by a horizontally extending narrow side of a top wall of the furniture body.

According to an embodiment, the drive unit has a housing and/or a mounting plate, and the mounting abutment is in the form of a component separate from the housing and/or from the mounting plate. In that way, a damaged mounting abutment can be easily replaced.

The mounting abutment can be mounted moveably relative to the drive unit. Preferably, the mounting abutment is mounted pivotably and/or displaceably relative to the drive unit between a first position and a second position.

According to a further embodiment, the mounting abutment is pre-fitted to the drive unit, and the mounting abutment, in the pre-fitted state, is mounted to the drive unit displaceably and/or pivotably relative to the drive unit.

According to a further embodiment, a cover cap can be provided. The cover cap at least partially covers the mounting abutment in the first position and/or a lateral visible region of the furniture drive in the mounted state. The cover cap can preferably have a curved portion adapted so as to cover the mounting abutment in its first position.

In the case of an article of furniture comprising at least one furniture drive, the article of furniture can have a furniture body and a furniture part, preferably a flap, which is movable upwardly relative to the furniture body. The furniture part is mounted movably by the furniture drive between a closed position and a position of being lifted relative to the furniture body. The movement of the furniture part relative to the furniture body is therefore assisted by the furniture drive, for example by a spring device and/or by an electric drive.

For the sake of simplicity hereinafter, instead of "the housing and/or the mounting plate" of the drive unit, reference is made to a "mounting plate", in which respect, however, the same details are also applicable to the housing.

BRIEF DESCRIPTION OF THE DRAWINGS

Further advantages and details of the invention will be apparent from the Figures and the related specific description. In the drawing.

DETAILED DESCRIPTION OF THE INVENTION

Figure 1A:
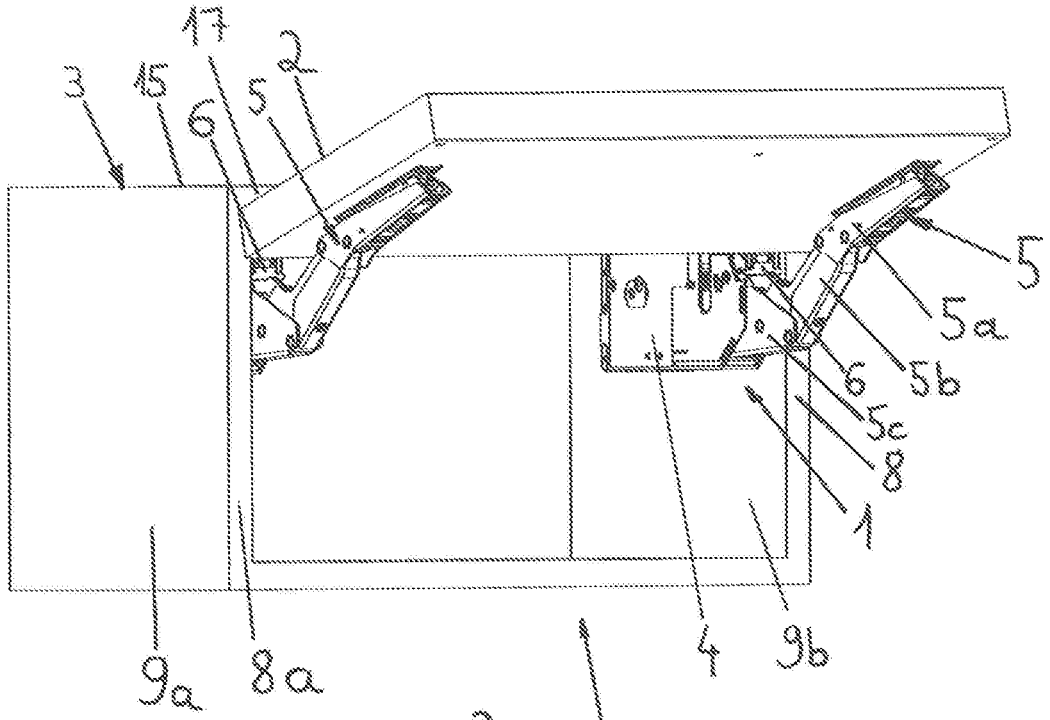
FIGS. 1*a*, 1*b* show an article of furniture comprising a furniture body and a movable furniture part, the furniture part being movable by furniture drives.

FIG. 1*a* shows an article of furniture 16 having a furniture body 3 and a furniture part 2 upwardly movable relative to the furniture body 3. The upwardly movable furniture part 2, in this figure, is in the form of a furniture flap. In addition, arranged at the two side walls 9*a*, 9*b* is a respective furniture drive 1, and each of the furniture drives 1 has a drive unit 4 and at least one moveably mounted actuating portion 5. The furniture part 2, in this case, is movable by the actuating portions 5 between a closed position and a position of being lifted relative to the furniture body 3. In FIG. 1, the furniture part 2 is shown in a lifted position. The actuating portions 5 can also have a multi-part structure. The furniture drive 1 arranged at the side wall 9*b* has, for example, three actuating arms 5*a*, 5*b*, 5*c* hingedly connected to one another. In this connection, it is additionally noted that the actuating portions 5 do not have to be connected directly to the furniture part 2. An indirect connection by further levers and/or fitments can also be provided.

Figure 1B:
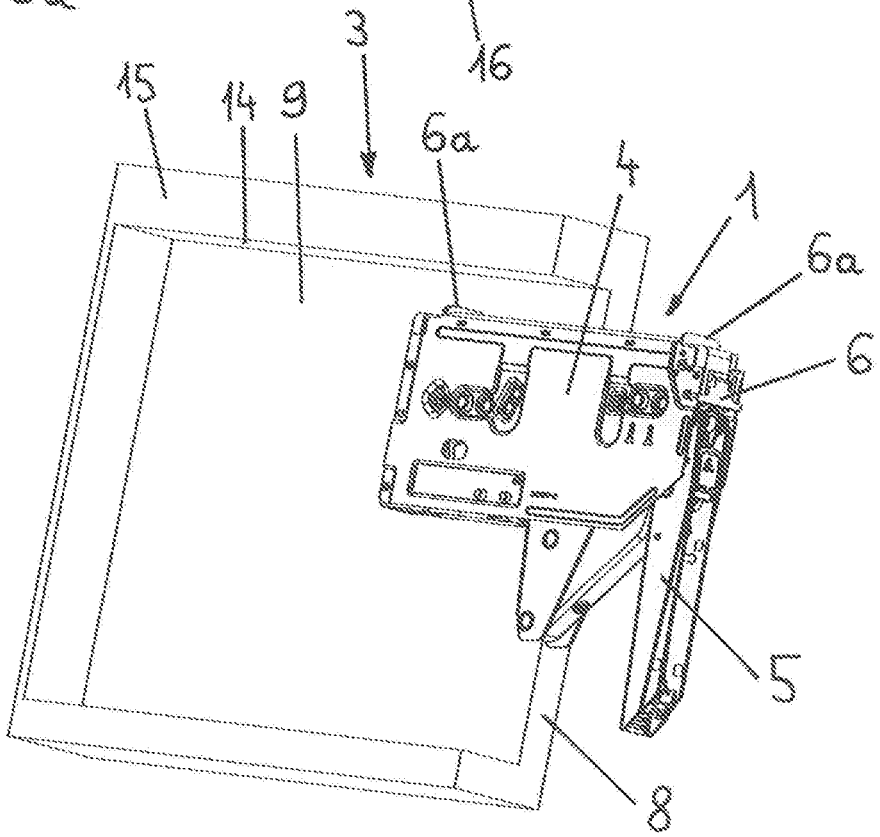

FIG. 1*b* shows a wall 9 and a portion of a top wall 15 of a furniture body 3. The furniture drive 1, in this case, is not yet positioned at a predetermined mounting position. In addition, the furniture drive 1 has a drive unit 4, a movably mounted actuating portion 5, a substantially T-shaped mounting abutment 6 and two abutments 6*a*. The mounting abutment 6, in this case, is mounted movably relative to the drive unit 4. The two abutments 6*a* serve for positioning in respect of height of the drive unit 4 in the furniture body 3. The top wall 15 has an underside 14, wherein the abutments 6*a* can be bear against that underside 14 of the top wall 15.

Figure 2A:
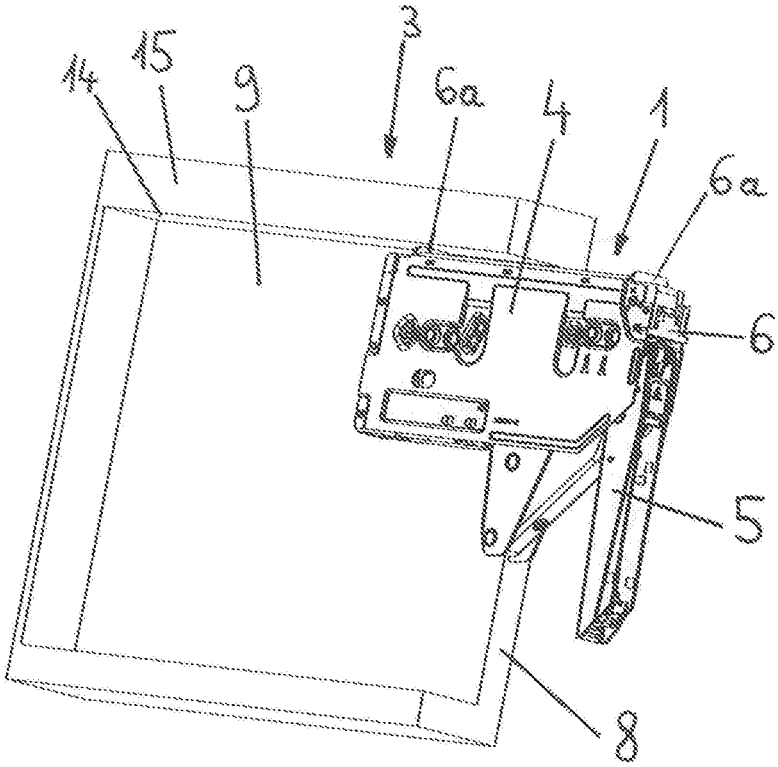
FIGS. 2*a*-2*c* show a wall of a furniture body and a furniture drive in a position which is positioned in respect of height or in respect of height and depth respectively, and an enlarged detail view in relation thereto.

FIG. 2*a* shows a wall 9 and a portion of a top wall 15 of a furniture body 3. The top wall 15 has an underside 14, and the two abutments 6*a* can bear against the underside 14. Once again, the furniture drive 1 has a drive unit 4, an actuating portion 5 mounted pivotably relative to the drive unit 4, a mounting abutment 6 and the two above-mentioned abutments 6*a*. The substantially T-shaped mounting abutment 6 serves for bearing against the front face 8 of the wall 9. As a difference in relation to FIG. 1*b*, the abutment 6*a* shown at the left in the view is already bearing against the underside 14 of the top wall 15 and thus the drive unit 4 is pre-positioned in respect of height in the furniture body 3. The abutment 6*a* shown at the right is subsequently to be bear against the underside 14 of the top wall 15.

Figure 2B:
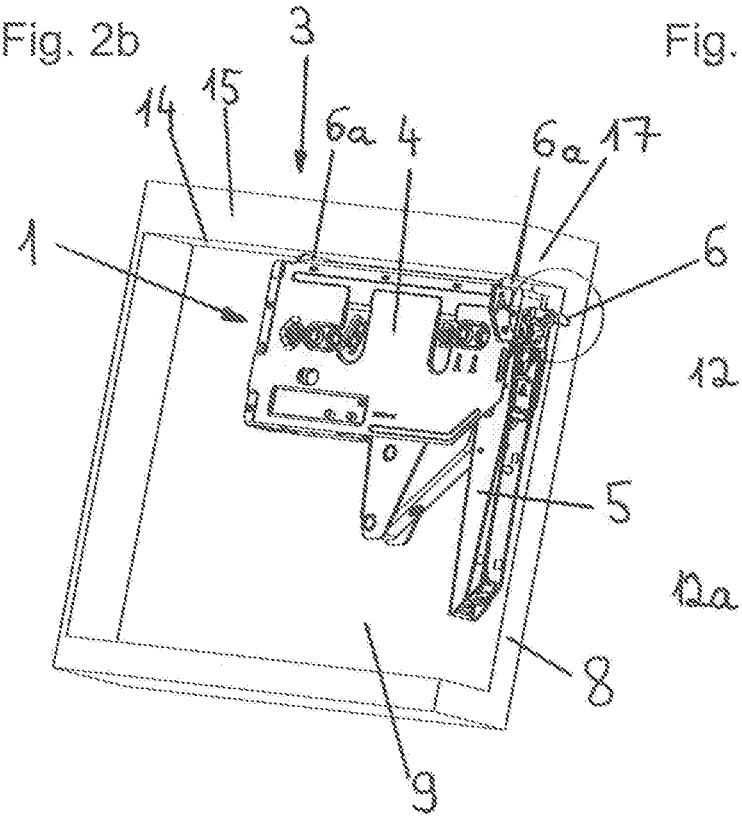

FIG. 2*b* shows the wall 9 and a portion of the top wall 15 of the furniture body 3. The illustrated furniture drive 1 is now positioned at a predetermined mounting position on the wall 9 in the furniture body 3. The two abutments 6*a* serving for heightwise positioning of the drive unit 4 bear against the underside 14 of the top wall 15. The mounting abutment 6 is applied to the end 8 of the wall 9, so that the drive unit 4 is positioned in respect of depth in the furniture body 3.

By virtue of a flat side of the drive unit 4 bearing against the wall 9, the drive unit 4 is fixed in all directions in the furniture body 3 at a predetermined mounting position. In contrast to FIG. 2*a*, the mounting abutment 6 is shown in a pivoted and displaced position so that the mounting abutment 6 can be applied to the front face 8. As an alternative thereto, it is also possible for a flat side of the drive unit 4 to bear against the underside 14 of the top wall 15, so that the mounting abutment 6 can be applied to the front face 17 of the top wall 15.

Figure 2C:
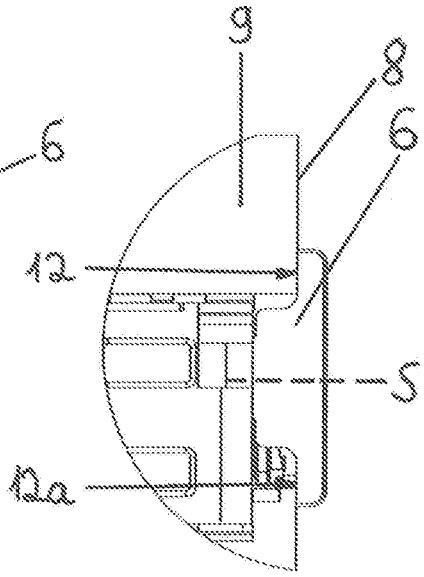

FIG. 2*c* shows an enlarged view of the region circled in FIG. 2*b*. In this respect, it can be seen that the mounting abutment 6 has an axis of symmetry S, and the mounting abutment 6 has a structure of mirror-image symmetry with respect to the axis of symmetry S. Therefore, the mounting abutment 6 can be selectively applied by a movement towards the left or towards the right against two different front faces 8, 8*a* of two mutually opposite side walls 9*a*, 9*b* of the furniture body 3. Accordingly, the illustrated furniture drive 1 can be positioned both at left and also at right side walls 9*a*, 9*b* of a furniture body 3. In addition, the mounting abutment 6 has the two abutment surfaces 12, 12*a* arranged symmetrically relative to the axis of symmetry S. In FIG. 2*c*, the abutment surface 12 is applied against the front face 8.

Figure 3A:
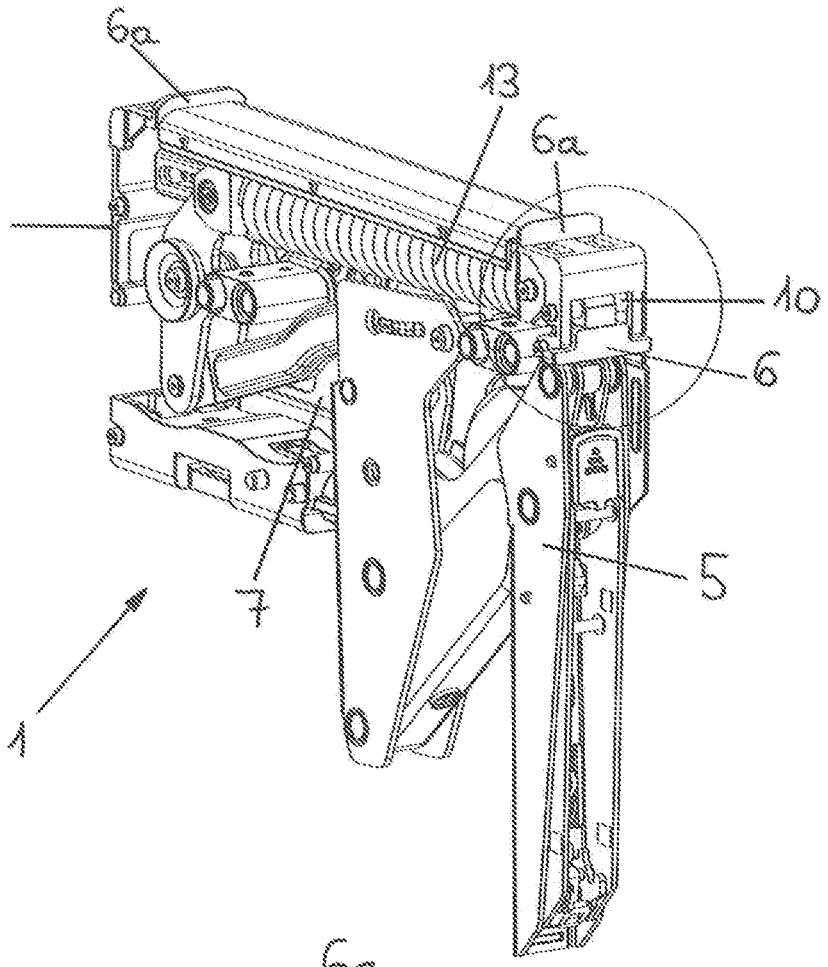
FIGS. 3*a*, 3*b* are a perspective view and an enlarged detail view in relation thereto of the furniture drive of FIG. 1*a*, FIGS. 4*a*, 4*b* are a perspective view and an enlarged detail view in relation thereto of the furniture drive of FIG. 1*a*, FIGS. 5*a*-5*c* are a perspective view and two enlarged detail views in relation thereto of the furniture drive of FIG. 1*a*, and FIGS. 6*a*-6*d* show the mounting abutment in different positions.

FIG. 3*a* shows a perspective view of the furniture drive 1, wherein the drive unit 4 includes a mounting abutment 6 mounted movably by a pin 10. In addition, the drive unit 4 has a mounting plate 7 serving for fixing the drive unit 4 to a wall 9. Furthermore, there is provided a spring device 13 for applying a force to the actuating portion 5.

Figure 3B:
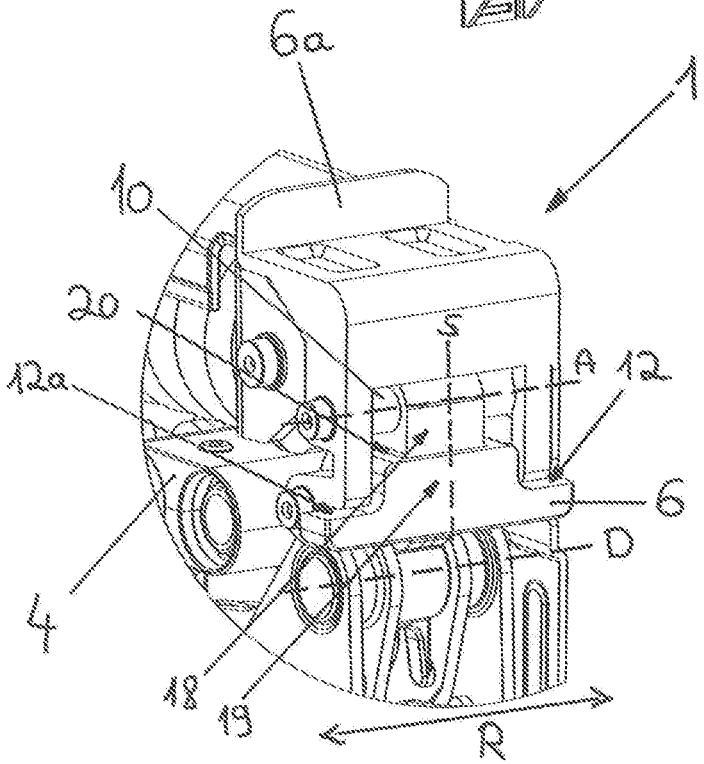

FIG. 3*b* shows an enlarged view of the region circled in FIG. 3*a*. In that respect, the two abutment surfaces 12, 12*a* of the mounting abutment 6 can be clearly seen, and those two abutment surfaces 12, 12*a* serve for bearing against the front faces 8, 8*a* of two mutually opposing side walls 9*a*, 9*b*. It is also possible to see the axis A, about which the mounting abutment 6 is mounted pivotably. The drive unit 4 has a recess 20 for receiving the mounting abutment 6. The mounting abutment 6 has a first leg 18 and a second leg 19. The width of the first leg 18 is less than the width of the recess 20 and the width of the second leg 19 approximately corresponds to the width of the recess 20. Therefore, displacement of the mounting abutment 6 along the pin 10 or along the axis A in the direction R is possible only after an at least partial pivotal movement of the mounting abutment 6 relative to the drive unit 4. The actuating portion 5 (not visible in this Figure) is mounted pivotably relative to the drive unit 4 about the axis of rotation D, and the axis of rotation D and the axis A extend substantially parallel to each other. The direction R in which the mounting abutment 6 is displaceable also extends in parallel spaced relationship with the axis of rotation D.

Figure 4A:
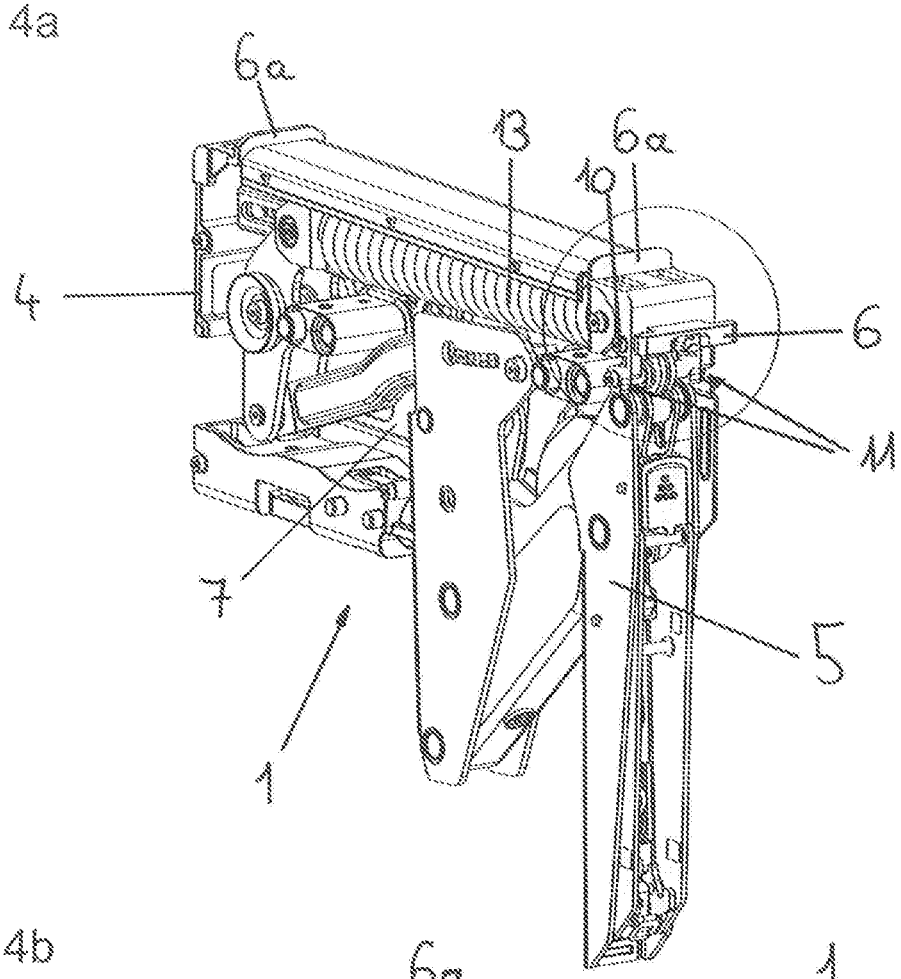

FIG. 4*a* shows a perspective view of the furniture drive 1. As a difference in relation to FIG. 3*a*, the mounting abutment 6 is shown in a pivoted position. It is also possible to see the mounting plate 7 which is suitable for fixing the drive unit 4 to a wall 9 by screws or dowels (not shown).

Figure 4B:
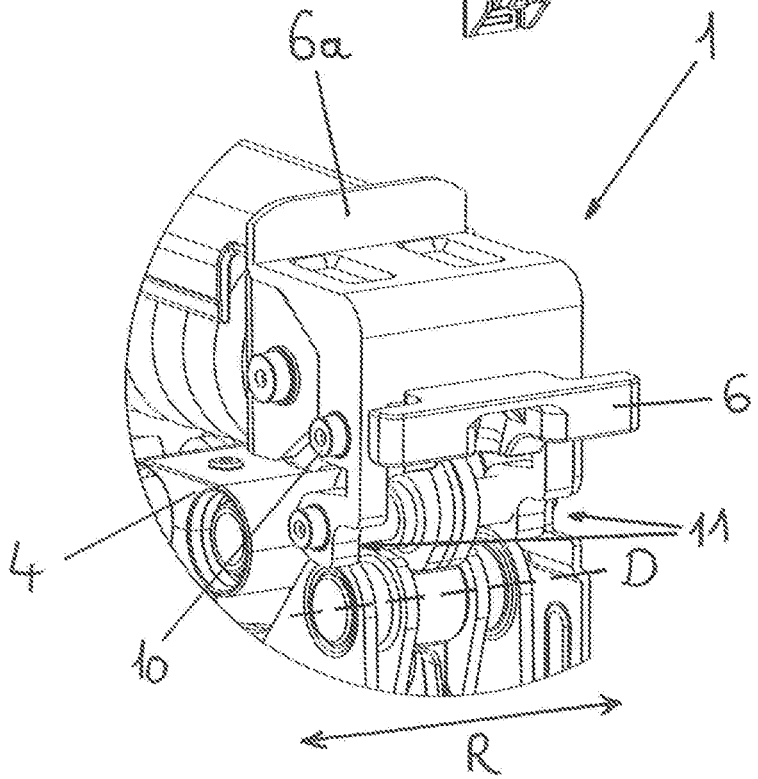

FIG. 4*b* shows a detail view of FIG. 4*a*. With regard to the axis of rotation D of the actuating portion 5 and the direction R, reference is directed to the description of FIG. 3*b*. In addition, the recess 11 of the drive unit 4 into which the mounting abutment 6 can be at least partially received in its first position as shown in FIG. 3*a* is clearly visible.

Figure 5A:
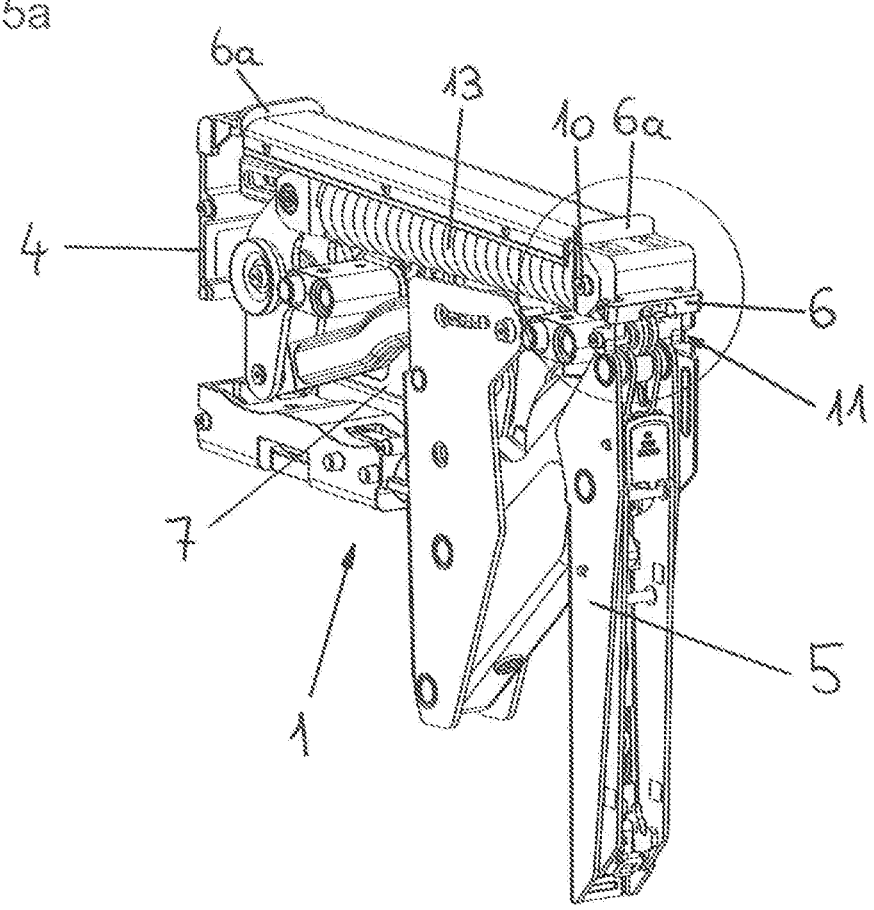

FIG. 5*a* shows the furniture drive 1 according to FIG. 4*a* with a further position of the mounting abutment 6 which, in addition to the pivoted position in FIG. 4*a*, is also displaced towards the left along the pin 10.

Figure 5B:
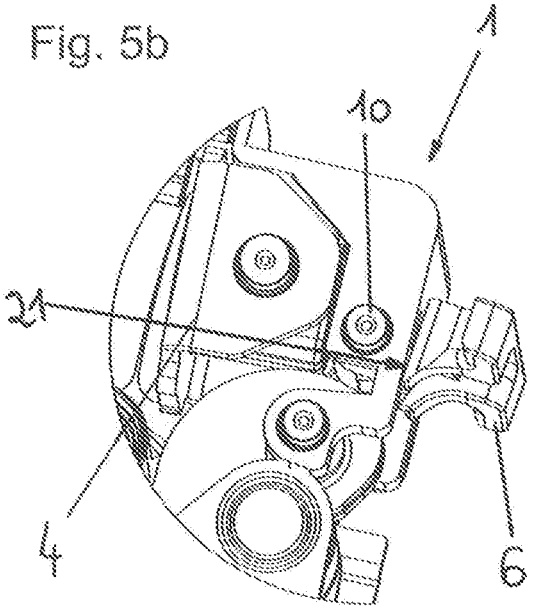

FIG. 5*b* shows another perspective view of the circled region in FIG. 5*a*. In order for the mounting abutment 6 to be held in the second position in a predetermined location, the mounting abutment 6 has a flattened region 21. A further flattened region 21 is also provided symmetrically relative to the axis of symmetry S on the other side. In that way, the mounting abutment 6 is also held in a predetermined position in the position of being displaced towards the right along the pin 10. The mounting abutment therefore does not drop down under its own weight in the position of being displaced towards the left or towards the right. The references to "up" and "down" respectively refer to the usual mounted position of the furniture drivel.

Figure 5C:
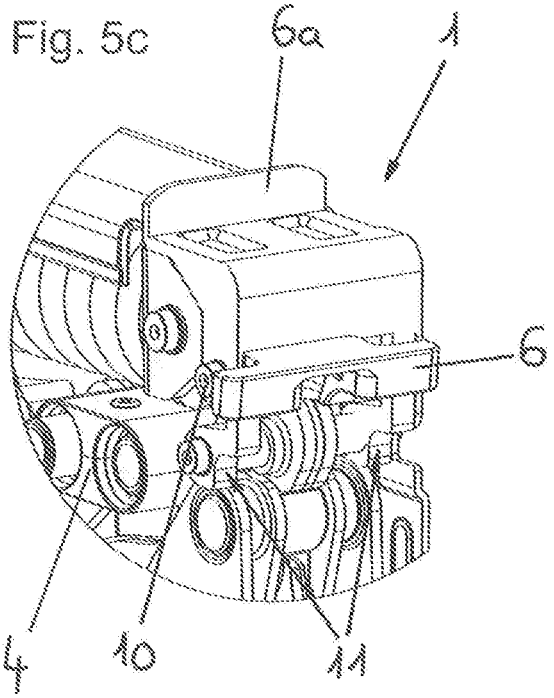

FIG. 5*c* shows a further perspective view of the detail region shown in FIG. 5*b*. In this respect, it is possible to see the recess 11 provided for at least partially receiving the mounting abutment 6 in its first position.

Figure 6A:
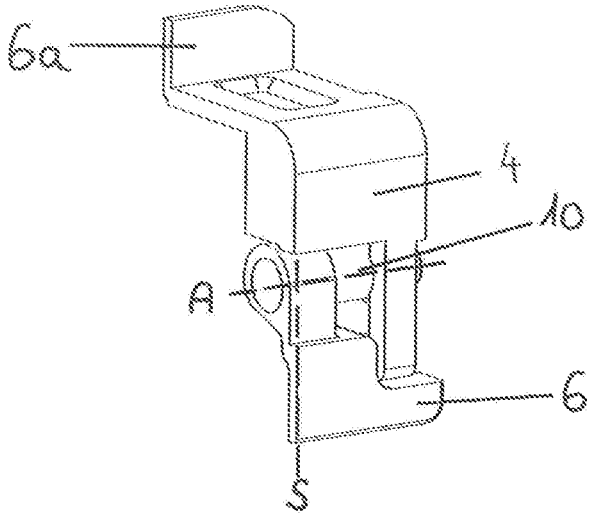

FIG. 6*a* shows a cross-sectional view of the mounting abutment 6 along the axis of symmetry S of the mounting abutment 6. The mounting abutment 6 is mounted movably by the pin 10 relative to the drive unit 4 and is in the first position in this Figure. It is also possible to see the axis A, about which the mounting abutment 6 is mounted pivotably and is displaceable along that axis A.

Figure 6B:
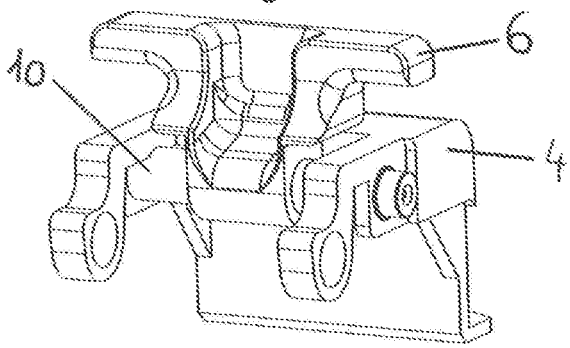

FIG. 6*b* shows the mounting abutment 6, in contrast to FIG. 6*a*, in a position of being pivoted about the pin 10.

Figure 6C:
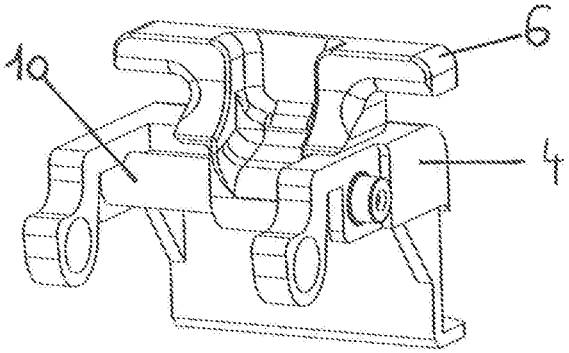
Figure 6D:
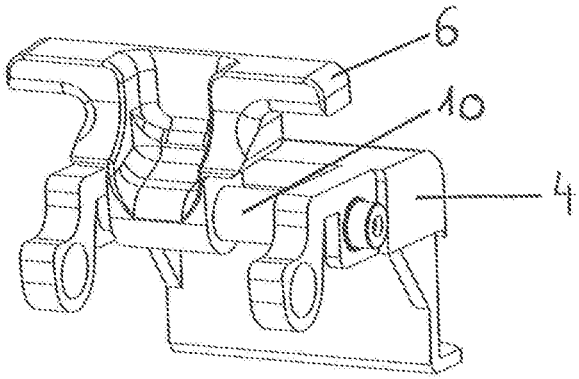

FIGS. 6*c* and 6*d* show the mounting abutment 6 in a position of being displaced along the pin 10. That position respectively corresponds to the second position of the mounting abutment 6. Furthermore, that position corresponds to the mounted state of the furniture drive 1, and the drive unit 4 of the furniture drive 1 in this position can be positioned both in respect of height and also in respect of depth on or in the furniture body 3. It can also be seen from these two Figures that the flattened region 21 of the mounting abutment 6, shown in FIG. 5*b*, at least partially bears against the drive unit 4 in the second position and thus the mounting abutment 6 is prevented from dropping down under its own weight.

The method according to the invention for mounting the furniture drive 1 is described with reference to FIGS. 1*b*, 2*a* and 2*b*. In that respect, the following steps are performed:

moving the drive unit 4 into a position until the mounting abutment 6 bears against the front face 8 of the wall 9 of the furniture body 3, so that the drive unit 4 is positioned in respect of depth at a predetermined mounting position in the furniture body 3, fixing the drive unit 4 at the predetermined mounting position in the furniture body 3, preferably by means of screws or dowels (not shown).

The following step can be provided prior to the movement of the drive unit 4:

pivoting and/or displacing the mounting abutment 6 relative to the drive unit 4 into a second position in which the mounting abutment 6 projects transversely from the drive unit 4, so that the mounting abutment 6 can bear against a front face 8 of the furniture body 3.

In addition, the following step can be performed prior to or after fixing of the drive unit:

pivoting and/or displacing the mounting abutment 6 relative to the drive unit 4 into a first position in which the mounting abutment 6 is at least partially received in a recess 11 of the furniture drive 1.

In that respect, the following step can be performed prior to fixing of the drive unit:

moving the drive unit 4 into a position until at least one of the abutments 6*a* of the drive unit 4, that are separate from the mounting abutment 6, bears against the underside 14 of the top wall 15 of the furniture body 3, so that the drive unit 4 is positioned in respect of height at a predetermined mounting position in the furniture body 3.

It is noted at this juncture that it is not absolutely necessary for the movement of the drive unit 4 for heightwise position to be carried out prior to the movement of the drive unit 4 for positioning in respect of depth. That can also be carried out in the reverse sequence.

To facilitate the movement of the drive unit 4, the drive unit 4 can bear against the wall 9 of the furniture body 3 during the positioning movement and can be displaced along that wall 9.

LIST OF REFERENCES

1 furniture drive
2 moveably mounted furniture part
3 furniture body
4 drive unit
5 actuating portion
5*a* actuating arm
5*b* actuating arm
5*c* actuating arm
6 mounting abutment
6*a* abutment
7 mounting plate
8 front face
8*a* front face
9 wall
9*a*, 9*b* side wall
10 pin
11 recess
12 abutment surface
12*a* abutment surface
13 spring device
14 underside
15 top wall
16 article of furniture
17 end of the top wall
18 first limb of the mounting abutment
19 second limb of the mounting abutment
20 recess
21 flattened region of the mounting abutment
D axis of rotation
A axis
R direction
S axis of symmetry

The invention claimed is:

1. A furniture drive for moving a movably mounted furniture part relative to a furniture body, the furniture drive comprising:

a drive unit to be mounted to or in the furniture body;

a movably-mounted actuating portion configured to move the movable furniture part; and a mounting abutment pre-fitted to the drive unit, the mounting abutment being configured to bear against the furniture body, wherein the mounting abutment pre-fitted to the drive unit is mounted pivotably and/or displaceably relative to the drive unit, and wherein the mounting abutment is mounted displaceably in a direction extending a in parallel spaced relationship with the axis of rotation of the actuating portion.

2. A furniture drive for moving a movably mounted furniture part relative to a furniture body, the furniture drive comprising:

a drive unit to be mounted to or in the furniture body;

a movably-mounted actuating portion configured to move the movable furniture part; and a mounting abutment pre-fitted to the drive unit, the mounting abutment being configured to bear against the furniture body, wherein the mounting abutment pre-fitted to the drive unit is mounted pivotably and/or displaceably relative to the drive unit, and wherein the mounting abutment is mounted displaceably along a pin.

3. A furniture drive for moving a movably mounted furniture part relative to a furniture body, the furniture drive comprising:

a drive unit to be mounted to or in the furniture body;

a movably-mounted actuating portion configured to move the movable furniture part; and a mounting abutment pre-fitted to the drive unit, the mounting abutment being configured to bear against the furniture body, wherein the mounting abutment pre-fitted to the drive unit is mounted pivotably and/or displaceably relative to the drive unit, and wherein the actuating portion is mounted pivotably relative to the drive unit about an axis of rotation, the mounting abutment being mounted pivotably about an axis.

4. The furniture drive according to claim 3, wherein the axis about which the mounting abutment is mounted is parallel to the axis of rotation.

5. A furniture drive for moving a movably mounted furniture part relative to a furniture body, the furniture drive comprising:

a drive unit to be mounted to or in the furniture body;

a movably-mounted actuating portion configured to move the movable furniture part; and a mounting abutment pre-fitted to the drive unit, the mounting abutment being configured to bear against the furniture body, wherein the mounting abutment pre-fitted to the drive unit is mounted pivotably and/or displaceably relative to the drive unit, and wherein the mounting abutment is mounted so as to have limited movement between a first position and a second position, wherein the mounting abutment is arranged so that:

in the first position, the mounting abutment is at least partially received in a recess of the furniture drive, and, in the second position, the mounting abutment projects transversely from the drive unit to be applied to a front face of the furniture body.

6. The furniture drive according to claim 5, wherein the mounting abutment includes an abutment surface for bearing against the front face of the furniture body.

7. The furniture drive according to claim 6, wherein the mounting abutment includes at least two abutment surfaces configured to alternatively bear against two different front faces of two mutually opposing side walls of the furniture body.

8. The furniture drive according to claim 7, wherein the mounting abutment has an axis of symmetry, the at least two abutment surfaces being arranged in a mirror-image symmetrical relationship with respect to the axis of symmetry.

9. A furniture drive for moving a movably mounted furniture part relative to a furniture body, the furniture drive comprising:

a drive unit to be mounted to or in the furniture body;

a movably-mounted actuating portion configured to move the movable furniture part; and a mounting abutment pre-fitted to the drive unit, the mounting abutment being configured to bear against the furniture body, wherein the mounting abutment pre-fitted to the drive unit is mounted pivotably and/or displaceably relative to the drive unit, and wherein the mounting abutment has a substantially T-shaped configuration.

10. A method of mounting a furniture drive to a furniture body, the furniture drive including a drive unit to be mounted to or in the furniture body, a movably-mounted actuating portion configured to move a movable furniture part relative to the furniture body, and a mounting abutment pre-fitted to the drive unit, the mounting abutment being configured to bear against the furniture body, wherein the mounting abutment pre-fitted to the drive unit is mounted pivotably and/or displaceably relative to the drive unit, the method comprising:

moving the drive unit into a position until a mounting abutment abuts against a front face of a wall of the furniture body, so that the drive unit is positioned in respect of depth at a predetermined mounting position at or in the furniture body;

fixing the drive unit at the predetermined mounting position to or in the furniture body; and prior to the moving of the drive unit, pivoting and/or displacing the mounting abutment relative to the drive unit into a position in which the mounting abutment projects transversely from the drive unit, so that the mounting abutment bears against a front face of the furniture body.

11. The method according to claim 10, wherein the position is a second position, the method further comprising, prior to or after fixing of the drive unit, pivoting or displacing the mounting abutment relative to the drive unit into a first position in which the mounting abutment is at least partially received within a recess of the furniture drive.

12. The method according to claim 10, further comprising, prior to the fixing of the drive unit, moving the drive unit into a position until an abutment of the drive unit separate from the mounting abutment bears against an underside of a top wall of the furniture body, so that the drive unit is positioned in respect of height at a predetermined mounting position at or in the furniture body.

13. The method according to claim 10, wherein the drive unit bears against a wall of the furniture body during the moving of the drive unit, and is displaced along the wall.

14. The method according to claim 10, wherein the fixing of the drive unit at the predetermined mounting position is by screws or dowels.

* * * * *